United States Patent [19]

Karru et al.

[11] 4,343,227

[45] Aug. 10, 1982

[54] HYDRAULIC PERCUSSION APPARATUS

[75] Inventors: Esa Karru; Pekka Salmi, both of Tampere; Hannu Paasonen, Nokia, all of Finland

[73] Assignee: Oy Tampella AB, Finland

[21] Appl. No.: 162,157

[22] Filed: Jun. 23, 1980

[30] Foreign Application Priority Data

Jun. 26, 1979 [FI] Finland ..... 792019

[51] Int. Cl.[3] ..... F01B 7/18

[52] U.S. Cl. ..... 91/276; 91/298

[58] Field of Search ..... 91/276, 298, 297, 300, 91/321, 319

[56] References Cited

U.S. PATENT DOCUMENTS 4,028,995 6/1977 Salimi ..... 91/276

4,084,486 4/1978 Juvonen ..... 91/276

FOREIGN PATENT DOCUMENTS 402643 3/1974 U.S.S.R. ..... 91/276

*Primary Examiner*—Alan Conan

*Attorney, Agent, or Firm*—Hill, Van Santen, Steadman, Chiara & Simpson

[57] ABSTRACT

A hydraulic percussion apparatus comprising a body, a cylinder in the body and a percussion piston reciprocating in the cylinder. A distributing valve moves in a valve housing. A valve for starting and stopping the percussion apparatus is provided. A hydraulic pump and hydraulic channels form a percussion circuit with a gas/liquid pressure accumulator. A distributing valve circuit and a free circulation circuit are provided for the pump which are parallelly coupled with the percussion circuit, which circuits are connected to the pump and to the start-and-stop valve which has positions for controlling pressure in the circuits. The start-and-stop valve has a middle position during which pressure in the percussion circuit rises up to a predetermined value while the distributing valve circuit remains closed independent of the pressure in the percussion circuit.

5 Claims, 1 Drawing Figure

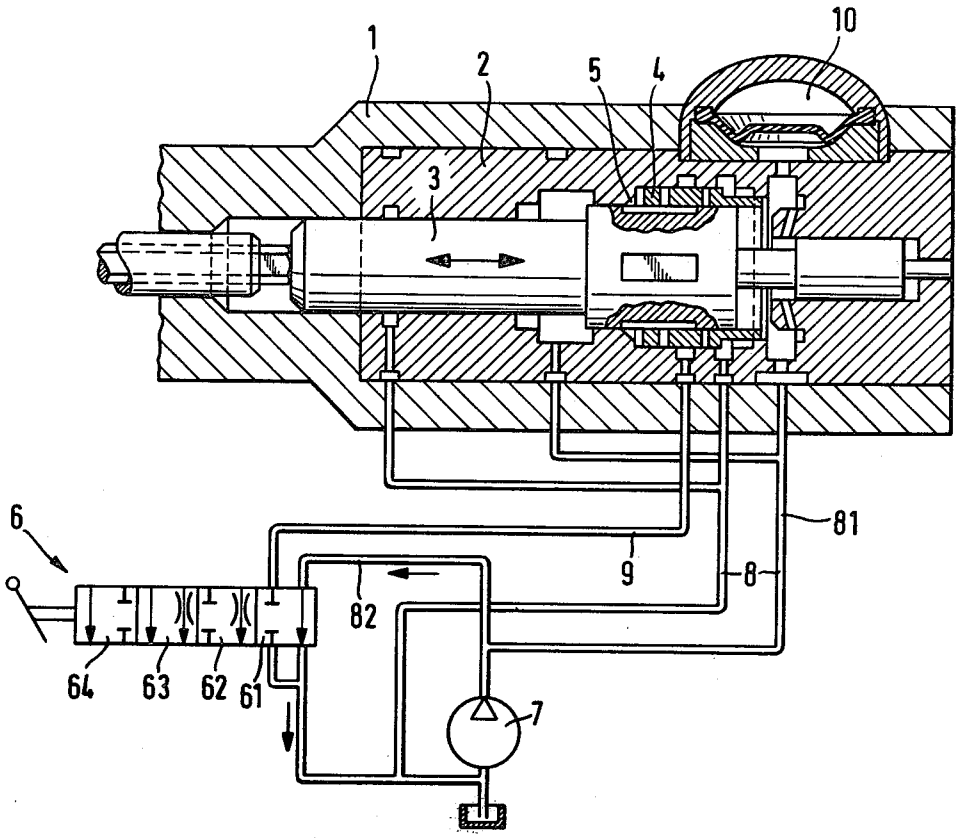
10
4
5
2
3
1
81
8
9
7
82
61
62
63
64
6

HYDRAULIC PERCUSSION APPARATUS

This invention relates to a hydraulic percussion apparatus comprising a body, a cylinder in the body and a percussion piston reciprocating in the cylinder, a distributing valve to control the stroke of the piston and moving in a valve housing, a valve for starting and stopping the percussion apparatus, a hydraulic pump and hydraulic channels which form a percussion circuit with a gas/liquid pressure accumulator, a distributing valve circuit and a free circulation circuit for the pump which are parallelly coupled with the percussion circuit, which circuits are connected to the pump and to the start-and-stop valve which has positions for controlling pressure in the said circuits.

Three different methods are known for arranging the starting and stopping of the percussion apparatus.

1. The hydraulic circuit of the percussion appparatus is set on free circulation.

2. The power transmission medium is prevented from getting to the percussion mechanism.

In these cases the percussion mechanism is comprised of a percussion piston and of a distributing valve for controlling the piston.

In both cases a valve must be placed in the hydraulic channel which comes to the percussion mechanism, and therefore power is lost also during drilling. When these valves are used the percussion mechanism can be operated with random powers (pressures). Thereby it is likely that the pressure accumulator will get broken. An example of the first-mentioned case is German OS No. 2810285, where there is a valve for arranging the free circulation of the percussion mechanism.

The third method is to control the movement of the distributing valve.

German OS No. 1 703 753 shows an arrangement by which the access of the power transmission medium to the other end of the distributing valve is prevented. In this arrangement the free circulation of the pump has not been taken care of: when the percussion apparatus is not working, all power goes on heating the power medium.

Through Finnish application No. 760672 (German OS No. 25 12 731) it is known to affect the control valve of the percussion mechanism prior to each stroke. This is realized either by means of a separate valve built in the machine and comprised of a spool and a spring, or by throttling the flow channels. This construction has for example the following weak points. It demands exact machining of the slide and the valve box, it causes extra leakage points (power losses) and increases chances for defects. During 24 hours' work the spring, for example, strikes over three million times. Decrease of percussion rate when the flow channels are throttled causes loss of power which then heats the oil.

The object of the invention is to accomplish an improved hydraulic percussion apparatus in which the start-and-stop valve is arranged so that the above-mentioned disadvantages are eliminated.

In order to achieve this object the invention is characterized by a start-and-stop valve which has a middle position, during which the pressure in the percussion circuit rises to a predetermined value, while the distributing valve circuit is closed independent of the pressure in the percussion circuit. The start of the machine with too low pressure is prevented by raising the pressure in the percussion circuit above the filling pressure of the accumulator before the distributing valve circuit opens. Thus the risk is eliminated that the diaphragm of the accumulator would hit the bottom and break.

This new valve through which the operation of the machine can be controlled by one lever and which is applied in the percussion apparatus according to the invention, will be described in more detail in the enclosed subclaims.

In the following an embodiment of the invention will be described with reference to the enclosed drawing, which shows a schematic section and the hydraulic circuit diagrams of the hydraulic percussion apparatus according to the invention.

The hydraulic percussion apparatus comprises a body 1, a cylinder 2 in the body and a percussion piston 3 reciprocating in the cylinder. The motion of the piston 3 is controlled by a distributing valve 4 which moves in a valve housing 5. The function of the piston 3 and the distributing valve is described in Finnish patent No. 50940 (U.S. Pat. No. 4,028,995, the disclosure of which is herein incorporated by reference). The percussion apparatus is started and stopped by a valve 6, which is connected to the free circulation circuit 82 of the hydraulic pump 7. Parallel to this circuit is coupled also the percussion circuit 8 comprising a gas/liquid accumulator 10. Its construction and function are known to a professional man and are therefore not closer described here.

Valve 6 functions as follows. During the first position 61 of valve 6 the percussion apparatus is not working, because the free circulation 82 is open and the distributing valve circuit 9 is closed preventing the motion of valve 4. The second position 62 throttles the free circulation 82 of the pump and causes increase of pressure in circuit 8 up to a predetermined value while the distributing valve circuit 9 is still closed. This ensures that pressure in the percussion circuit 8 is above the filling pressure of the pressure accumulator 10 before the distributing valve circuit 9 opens. This prevents the starting of the machine with too low pressure and prevents the diaphragm of the pressure accumulator from hitting the bottom and getting broken. During position 63 also the free circulation 82 can be throttled in order to keep the pressure in the percussion circuit 8 at a predetermined value. The distributing valve circuit 9 is open allowing movement of valve 4 and starting of the percussion apparatus. During position 64 the free circulation 82 is closed and the distributing valve circuit 9 is open. Now the percussion apparatus receives full pressure and the percussion is at maximum power. Between positions 63 and 64 the percussion power is adjustable between the starting power limit and maximum value.

The start-and-stop valve 6 can be comprised of a spool which is turnable or axially movable in a valve box by one lever and in which there are cuttings for the open, closed and throttle positions, corresponding to the cuttings in the valve box.

We claim:

1. In a hydraulic percussion apparatus comprising:

a body member, a cylinder disposed within said body member, a piston reciprocable within said cylinder, a distributing valve controlling energization of said percussion apparatus, a hydraulic pump, an accumulator, means providing hydraulic channels between said pump and said accumulator to thereby form a percussion circuit, means providing hydraulic channels with said distributing valve to thereby form a distributing valve circuit, means providing a free circulation circuit in parallel with said percussion circuit, the improvement comprising:

a start-and-stop valve having a plurality of positions, including an intermediate position in which the pressure in said percussion circuit rises up to a predetermined value while said distributing valve circuit remains closed independently of the pressure in said percussion circuit.

2. A percussion apparatus according to claim 1, the improvement being, that during the first position (61) of the start-and-stop valve the pump (7) is directly connected to the tank and the distributing valve circuit (9) is closed, that in order to increase pressure in the percussion circuit during the second position (62) there is a throttle for the free circulation circuit (82) in the start-and-stop valve in the percussion circuit and that during the fourth position (64) the free circulation circuit (82) of the pump is closed and the distributing valve circuit (9) is fully open.

3. A percussion apparatus according to claim 1, the improvement being, that the start-and-stop valve (6) has four positions, the first position (61) being the stopping limit position of the percussion apparatus and the second position (62) increasing the pressure in the percussion circuit (81) up to a predetermined value while the distributing valve circuit (9) is closed, and the third position (63) keeping the pressure in the percussion circuit (81) at a predetermined value and opening and distributing valve circuit (9) and the fourth position (64) raising the pressure in the percussion circuit (81) to its maximum and keeping the distributing valve circuit (9) open.

4. A percussion apparatus according to claim 3, the improvement being that during the first position (61) of the start-and-stop valve the pump is connected directly to the tank and the distributing valve circuit (9) is closed, that during the second position (62) there is a throttle in the start-and-stop valve for the free circulation circuit (82) of the pump in order to increase pressure in the percussion circuit (8), that during the third position (63) there is a throttle in the start-and-stop valve for the free circulation circuit of the pump, and the distributing valve circuit (9) is open, and that during the fourth position (64) the free circulation circuit of the pump is closed and the distributing valve circuit (9) is open.

5. A percussion apparatus according to claim 1, the improvement being, that the predetermined value is higher than gas pressure in the pressure accumulator (10).

* * * * *